United States Patent [19]

Lucas

[11] 4,431,369

[45] Feb. 14, 1984

[54] GOVERNOR CONTROL LINKAGE ASSEMBLY FOR OVERSPEED PROTECTION OF TURBINES DURING RESTARTING

[75] Inventor: George M. Lucas, Wellsville, N.Y.

[73] Assignee: Edison International, Rolling Meadows, Ill.

[21] Appl. No.: 313,689

[22] Filed: Oct. 22, 1981

[51] Int. Cl.[3] ..... F01D 17/06; F01D 21/02; F16K 31/44

[52] U.S. Cl. ..... 415/36; 415/13; 415/20; 251/279; 251/234

[58] Field of Search ..... 415/20, 30, 32, 36, 415/37, 39, 40, 41, 42, 43; 74/625, 625 R; 251/231, 234, 279

[56] References Cited

U.S. PATENT DOCUMENTS

| | | | |
|---|---|---|---|
| 558,544 | 4/1896 | Wojan | 251/234 X |
| 927,368 | 7/1909 | Mauldin | 251/234 X |
| 1,416,391 | 5/1922 | Van Brunt | 251/234 |
| 1,630,133 | 5/1927 | Murphy | 251/231 |
| 1,879,415 | 9/1932 | Mutrux et al. | 251/231 X |
| 1,961,813 | 4/1932 | Caughey | 415/32 |
| 2,043,477 | 6/1936 | Imschweiler | 251/234 |
| 2,050,042 | 8/1936 | Davis | 251/234 X |
| 2,115,998 | 5/1938 | O'Connor | 251/234 |
| 2,257,279 | 9/1941 | Schmid | 415/32 |
| 2,524,343 | 10/1950 | Diener | 251/231 X |
| 3,461,893 | 8/1969 | Czuszak | 415/41 |
| 3,465,769 | 9/1969 | Shulock | 415/41 X |

FOREIGN PATENT DOCUMENTS

| | | | |
|---|---|---|---|
| 843774 | 8/1960 | United Kingdom | 251/234 |
| 1107805 | 5/1966 | United Kingdom | 251/231 |

*Primary Examiner*—Philip R. Coe
*Assistant Examiner*—Frankie L. Stinson
*Attorney, Agent, or Firm*—Thomas G. Anderson; Jon C. Gealow; James A. Gabala

[57] ABSTRACT

A governor control linkage assembly to be connected between the governor and a valve to be controlled by the governor such as the inlet valve for a steam turbine upstream from a venturi type safety trip valve therein in one preferred form with Woodward T.G.-10 governors has a main lever arm connected at one end to the governor for actuation thereof and to the opposite end to a pivot arm on a fulcrum assembly which permits the pivot arm to be moved by a manually operable threaded assembly connected thereto so as to move the inlet valve from open to closed position and from closed to open position when the turbine is shut down to aid in the restarting thereof. In another preferred form with Woodward P.G. governors the governor control linkage assembly consists of an articulated lever wherein a main lever arm and a pivot arm are connected so that the main lever and pivot arm can be moved relative to each other by an interconnecting manually operable threaded assembly to move the associated inlet valve from open to closed position and from closed to open position. The control linkage assemblies for the respective types of governors being operable essentially as shut-off devices to facilitate resetting of the associated safety trip valve with full line pressure at the steam chest and to be used as a manual control for restarting the turbine from the stopped position.

18 Claims, 16 Drawing Figures

GOVERNOR CONTROL LINKAGE ASSEMBLY FOR OVERSPEED PROTECTION OF TURBINES DURING RESTARTING

BACKGROUND OF THE INVENTION

This invention relates generally to governors and more specifically to a multi-unit governor control lever for resetting the governor to normal operation during start-up from a shut down or stopped position of the associated turbine or like apparatus controlled by the governor.

The present invention is illustrated with respect to a preferred usage thereof in a steam turbine where the governor acts to control inlet valve means disposed in the steam chest upstream from a safety trip valve in the inlet line feeding steam to the turbine.

Safety trip valves which are actuated responsive to any one or more of a plurality of adverse conditions potentially harmful to the continued operation of a steam or gas turbine act to cut off the flow of steam through the inlet passage for operating the steam or gas turbine. These single seated trip valves are adapted for use in single stage steam turbine systems because of their inherently low flow losses. However, they are subject to high unbalanced pressure forces and therefore present difficulties during the manual resetting of these valves particularly for example in steam turbines where the entering steam is at high temperatures and high pressures.

Further, those skilled in the art will recognize that the normal action of the governor causes the governor control lever to move the associated inlet valve means to the wide open position as the turbine speed drops when the safety trip valve is actuated to terminate delivery of steam through the inlet passage means to the turbine.

The problem heretofore presented is that when the safety trip valve is manually reset to the open position, if the governor does not respond reasonably promptly to the normal operating conditions desired, then the inlet valve means will cause the steam turbine to over speed and this will again trip the safety trip valve.

Some prior art devices have been developed to meet this problem as is shown in U.S. Pat. Nos. 2,257,279 and 1,786,942.

In the present invention this is accomplished by modifying the governor control lever to permit the inlet valve means upstream of the safety trip valve at the shut down or stopped position to be closed independently of the governor control lever operation and to enable the inlet valve means to move from closed to open position incrementally to bring the governor and its governor control lever back into normal operation, function and response to turbine operating conditions.

The governor control lever in accordance with the present invention is formed into a multi-section governor control linkage assembly wherein means are provided to adjust at least one section thereof relative the other to in turn first move the inlet valve means at the tripped, stopped or shut down position from open to closed position. Thereafter said means can be reversely operated to permit the inlet valve means to be moved incrementally from closed to open position so as to act as a throttling device for restarting the turbine and for bringing the turbine and its associated governor back to normal operating conditions.

Thus, the multi-section governor control linkage assembly in meeting the governor problem created when the safety trip valve is tripped as above outlined provides an inherent advantageous side effect in that with a relatively simple device, a manual control capability is established which heretofore as will be understood by those skilled in the art, had been provided by a more elaborate and expensive valve arrangement.

In addition to the throttling characteristic inherent in the governor control linkage assembly in accordance with the present invention, the construction effectively reduces the unbalanced forces acting across the safety trip valve. This occurs because after the safety trip valve is tripped and closed, and the inlet valve means is thereafter moved from open to closed position, the high temperature, high pressure steam trapped in the inlet flow passage between these elements will bleed off through clearances and/or orifices present in the safety trip valve thus balancing the pressure or forces acting across the valve head of the safety trip valve. Thus, manual forces required to reset the safety trip valve are materially reduced.

A third but still further important advantage which grows from the multi-section governor control linkage assembly in accordance with the present invention is that it can with a relatively few number of additional parts and connections be retrofitted to replace existing governor control levers and thus provide means for correcting this problem in existing turbine installations.

SUMMARY OF THE INVENTION

Thus, the present invention covers an improved control linkage assembly for a governor for operating an associated valve or the like device which includes, a main lever having one end connected to the means in the governor for operating the control linkage assembly, an auxiliary lever arm pivotally connected to the end of said main lever remote from the signal receiving end thereof, an operating rod for moving the valve being controlled by the governor pivotally connected in the control linkage assembly for operative association with the main lever and auxiliary lever arm, and means for incrementally moving the auxiliary lever arm so as to actuate the operating rod for moving said inlet valve from open to closed position and from closed to open position.

Accordingly, it is an object of the present invention to provide a control linkage assembly for a governor for closing the associated valve controlled by the governor and for incrementally reopening the associated valve during restarting of the turbine controlled by the associated valve.

It is a still further object of the present invention to provide an improved control linkage assembly for a governor and the associated valve controlled by the governor to provide means for reducing the unbalanced forces acting across the safety trip valve downstream of the said valve in the inlet flow passage of a turbine.

With these and other objects in view the invention will be better understood from the further description thereof with respect to the several forms of the invention herein illustrated in the accompanying drawings in which:

ONE FORM OF GOVERNOR CONTROL LINKAGE ASSEMBLY

Figure 1:
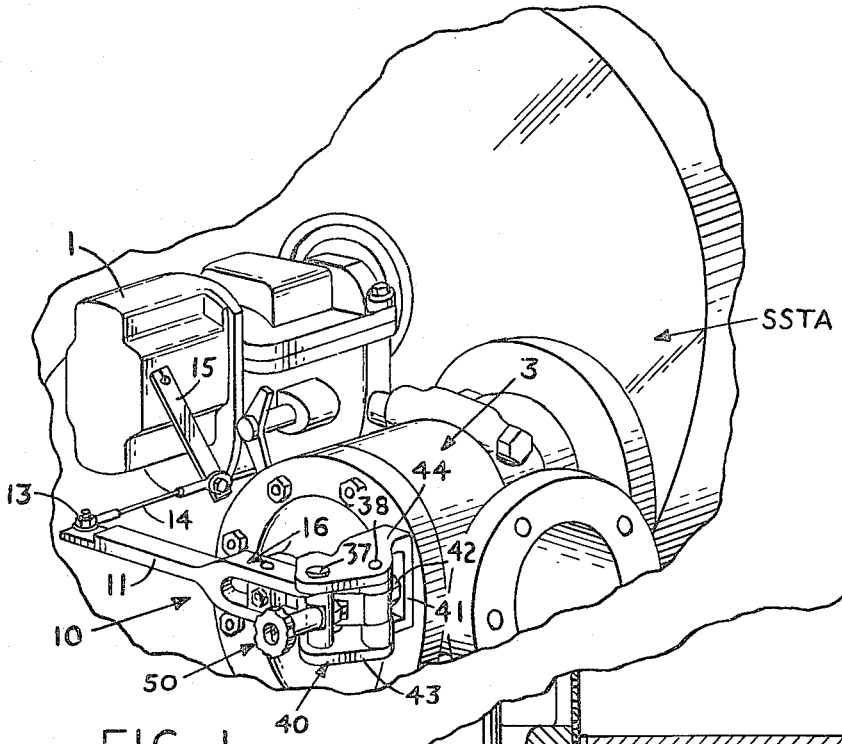
FIG. 1 is a partial perspective view of a portion of the casing of a steam turbine showing a Woodward T. G.-10 governor with one form of governor control linkage assembly in accordance with the present invention.
Figure 7:
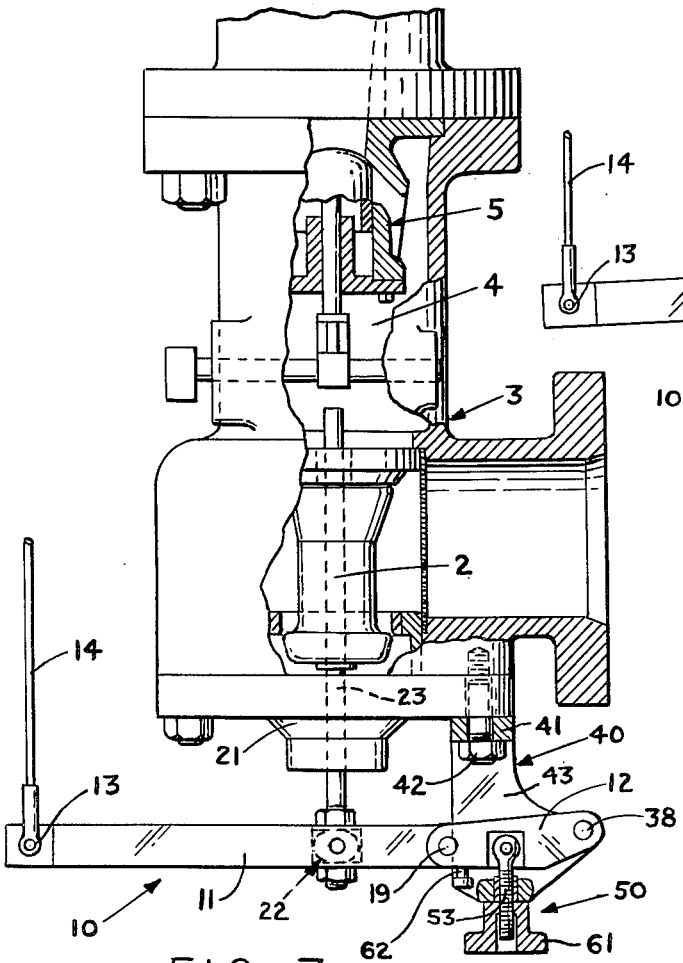
FIG. 7 is a diagrammatic sketch of the governor control linkage assembly shown in FIGS. 1 and 2 in operative association with the inlet valve in the steam chest of the turbine in the open position and showing the safety trip valve in the inlet flow passage in the closed position.
Figure 8:
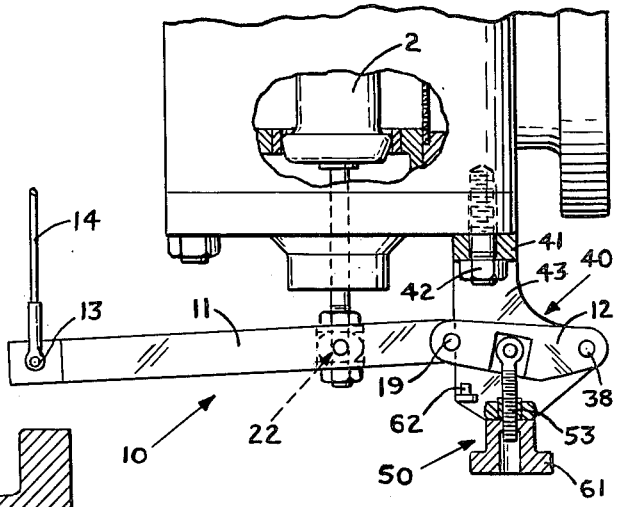
FIG. 8 is a fragment of the same diagrammatic sketch shown in FIG. 7 with the governor control linkage assembly and inlet valve for the turbine in the closed position.

Referring to the drawings FIGS. 1, 7 and 8 show one end of a single stage turbine generally designated SSTA which has a Woodward T. G.-10. Type governor 1 thereon for controlling the governor or inlet valve 2 which communicates with the steam chest generally designated 3 of the turbine.

The steam chest connects with an inlet passage 4 for delivering steam to the turbine and in the inlet passage 4 downstream of the inlet valve 2 will be a safety trip valve 5.

Woodward T. G.-10 type governors are easily purchaseable on the open market as is well known to those skilled in the art and accordingly will not be more fully described herein.

Governor 1 is connected to one end of a governor control linkage assembly generally designated 10 in accordance with this form of the present invention. As will be understood by those skilled in the art the governor will actuate the movement of the governor control linkage assembly in accordance with the predetermined speed setting desired for the turbine, i.e. when the turbine reduces its rotational speed due to an increased load, the governor will cause the governor control linkage assembly 10 to move the associated governor inlet valve 2 to a wider opening so as to increase the flow of steam to the turbine and thus increase the turbine speed to the point necessary to meet the requirements of the load and when the load decreases causing the turbine to increase its speed of rotation the governor control lever assembly will be operated by the governor so as to cause the inlet valve 2 to move to a lesser opening so as to reduce the amount of steam flowing to the steam turbine and hence the speed thereof.

Since a reduction in the speed of the governor 1 causes the governor control linkage assembly 10 to move the inlet valve 2 so that it increases the opening to the inlet passage 4 those skilled in the art will understand that when the safety trip valve 5 is tripped and cuts off the flow of steam to the turbine that the reduction in the speed of turbine as it slows down to the shutdown or stopped position responsive to the trip, will cause the governor 1 to move the governor or inlet valve 2 to the full open position as is shown in FIG. 7 of the drawings.

If this open position as shown in FIG. 7 of the drawings does not correct itself substantially instantaneously when the safety trip valve is manually opened to permit steam to flow to the steam turbine once again, the wide opened position of the governor or inlet valve 2 will cause the turbine to overspeed and trip the safety trip valve once again. This form of the invention provides one device to facilitate overcoming this problem.

Now referring to FIGS. 2 to 6 of the drawings, the governor control linkage assembly 10 in this form of the invention includes a main lever 11 and auxiliary lever or pivot arm 12 which are connected to each other and operatively associated so that the pivot arm 12 can displace or move the main lever 11 to in turn move the inlet valve from open to closed position and from closed to open position to achieve the advantageous results of the present invention.

Main lever 11 is connected at one end 13 to actuating rod 14 moved in turn by the rocker arm 15 of the governor 1. Thus, the main lever receives the governor signals directly.

The end of the main lever 11 remote from the end connected to the actuating rod 14 has a U-shaped connector 16 having spaced legs as at 17 and 18. A pivot pin 19 disposed across the legs 17 and 18 of the U-shaped connector 16 provides means for pivotally connecting one end 20 of the pivot arm 12 to this U-shaped end of the main lever 11. This pivotal connection forms a movable fulcrum for the main lever 11 which can act as hereinafter more fully described to move the main lever 11 towards and away from the cover 21 of the steam chest 3 of the turbine.

Figure 2:
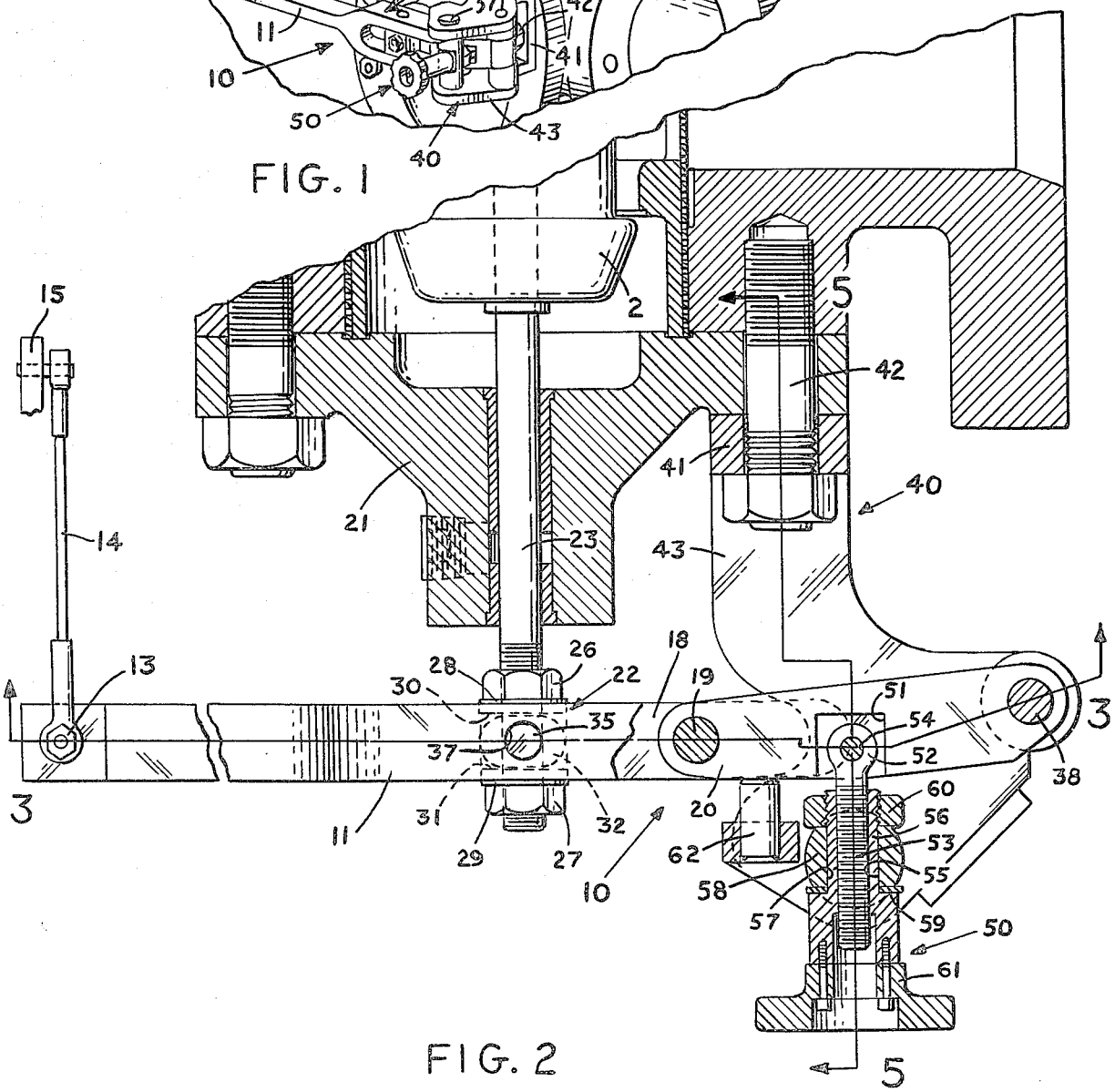
FIG. 2 is an enlarged top view partly in horizontal cross-section of the governor control linkage assembly shown in FIG. 1.
Figure 3:
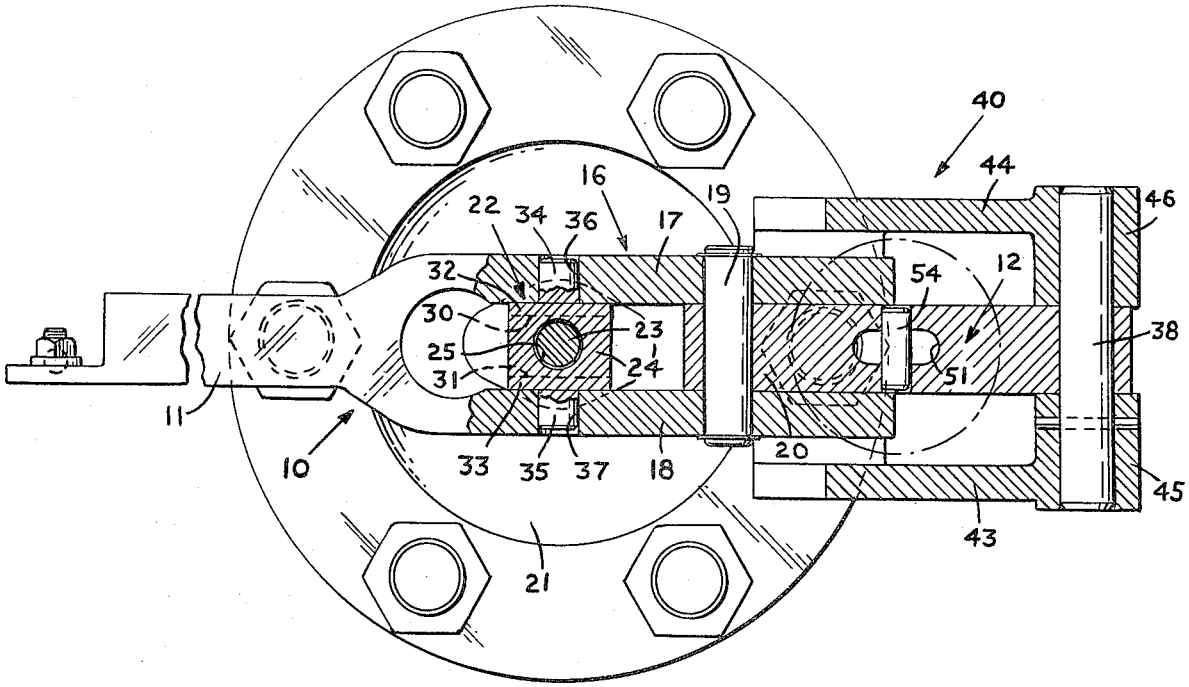
FIG. 3 is an enlarged end view partly in vertical cross-section of the governor control linkage assembly shown in FIG. 2.
Figure 4:
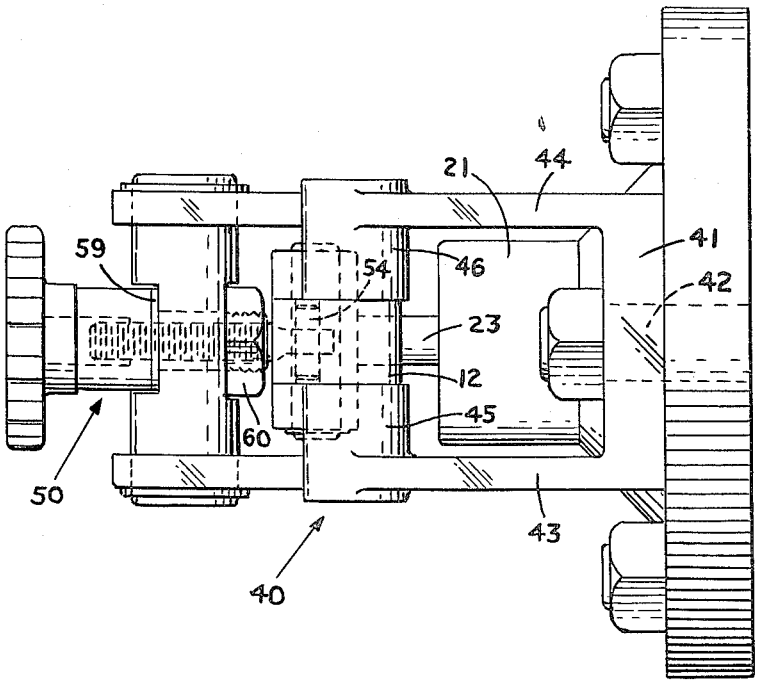
FIG. 4 is a right side view of the governor control linkage assembly shown in FIG. 2.
Figure 5:
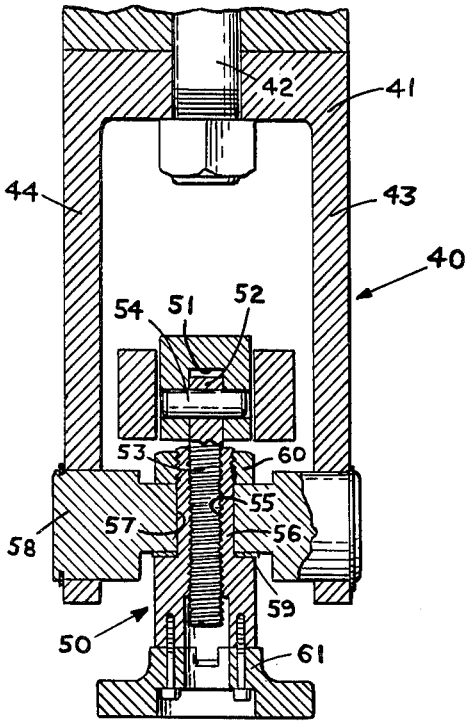
FIG. 5 is a vertical section taken on line 5—5 of FIG. 2.
Figure 6:
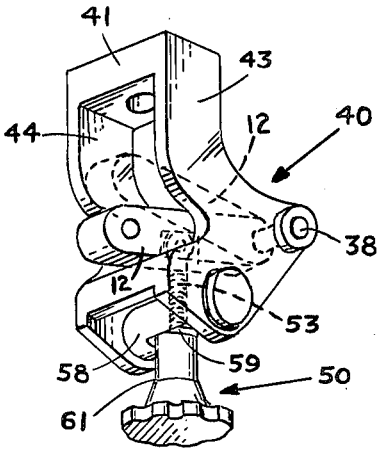
FIG. 6 is a perspective view of the manual operating means showing the position of the auxiliary lever or pivot arm in normal operating position and showing in dotted lines the pivot arm moved to closed position.

In the area of the main lever 11 generally adjacent the U-shaped connection 16, the main lever 11 is provided with a sliding assembly generally designated 22 for connecting the main lever 11 to the inlet valve stem 23 of the inlet valve 2 as is clearly shown in FIGS. 2 and 3 of the drawings.

Slide assembly 22 includes a centrally disposed pillow block 24 which has a bore 25 end to end therethrough into which the valve stem 23 extends. The valve stem 23 is held in its adjusted and calibrated position in the pillow block 24 by means of the inner jam nut 26 and outer jam nut 27 suitable inner lock washer 28 and outer lock washer 29 being provided for this purpose.

Pillow block 24 is sized to fit loosely between the legs 17 and 18 of the U-shaped connector 16 and in order to permit a relatively tight connection with sliding movement between the pillow block and the U-shaped legs 17 and 18 so that the pillow block can slide relative the main lever 11, the opposite faces of the pillow block 24 are grooved as at 30 and 31 to receive sliding members 32 and 33 therein which have outwardly projecting shafts respectively at 34 and 35 disposed in assembled position to fit into the aligned bores 36 and 37 on the respective legs 17 and 18 of the U-shaped connector 16 all of which is clearly shown at FIGS. 2, 3, 7 and 8 of the drawings.

Slide assembly 22 permits relative motion between the valve stem 23 and the main lever 11 so that the main lever and valve stem will not bind or hang-up when the main lever moves the valve stem 23 and inlet valve 3 responsive to the signals from the governor or when the main lever is moved during movement of the pivot arm 12 now to be described.

The pivot arm 12 extends from its point of connection to the main lever 11 in the longitudinal line thereof and at the end remote from the connection to the main lever 11 is connected to pivot about a pivot shaft or fulcrum 38 which is mounted in a combined fulcrum and manual operating assembly generally designated 40.

Fulcrum and manual operating assembly 40 includes a U-shaped pivot bracket whose base 41 is disposed to be connected to the cover 21 of the steam chest 3 by any suitable type of threaded means 42 so that the legs 43 and 44 of the U-shaped pivot bracket will project outwardly from the steam chest.

The legs 43 and 44 of the U-shaped bracket are generally parallel to each other and are spaced so that they are slightly wider than the arms 17 and 18 of the U-shaped connector 16 of the main lever 11. Further the legs 43 and 44 are curved so that the bushings 45 and 46 on the respective ends of the legs 43 and 44 in which the pivot shaft 38 is mounted will provide sufficient length for the pivot arm 12 to permit the end of the pivot arm 12 pivotally connected as at 19 to the adjacent end of the main lever 11 to move through an arc which will in turn provide the predetermined inward and outward movement necessary to cause the main lever 11 to move the valve stem 23 and inlet valve 2 from open to closed position after the safety trip valve 5 is tripped and from closed to open position when the turbine is restarted from the stopped or shut down position.

In order to move the pivot arm 12 the fulcrum assembly 40 is provided with a manual operator generally designated 50 as is shown in detail in FIGS. 2 to 6 of the drawings.

Thus FIGS. 2 to 6 show that in the medial section of the pivot arm 12 an opening 51 is formed in which the eyelet end 52 of an eye-bolt screw 53 is mounted as by the transverse pin 54.

Eye-bolt screw 53 extends transversely of the longitudinal axis of the aligned main lever 11 and pivot arm 12 and outwardly thereof for threaded connection with the threaded bore 55 disposed end to end through a sleeve 56 rotatably mounted in a bore 57 formed in a trunnion 58 which is connected across and adjacent to the outer ends of the respective legs 43 and 44 of the U-shaped bracket in spaced relation inwardly of the bushings 45 and 46 for the pivot shaft 38. The sleeve 56 is held in the bore 57 of the trunnion 58 by a disc spring 59 and locking collar 60 so that a handle member 61 on the outboard end thereof when manually rotated will cause the eye-bolt screw to thread inwardly or outwardly depending upon the direction in which the handle 61 is rotated. A stop member 62 is provided so that during the manual opening of the inlet valve 2 as hereinafter described the auxiliary lever or pivot arm 12 can be brought into exact longitudinal alignment so the governor control linkage assembly 10 may operate in the conventional manner for transmitting signals from the governor 1 to the inlet valve stem 23 and inlet valve 2. In this position the pivot shaft 19 for pivotally connecting the main lever 11 to pivot arm 12 acts as a fulcrum to enable the main lever 11 to operate in this manner.

OPERATION

The operation of the above described form of the present invention is best understood with reference to FIGS. 7 and 8 of the drawings.

In FIG. 7, the safety trip valve 5 is shown in the tripped position wherein the governor 1 has moved the inlet valve 2 to the wide open position in accordance with the normal response and operation of the governor.

By manually rotating the handle 61 in the proper direction the eye-bolt screw 53 can be moved inwardly so as to move the fulcrum 19 for the main lever 11 inwardly. Since the opposite end 13 is connected with the rod 14 which is now stationery the end 13 as a fixed fulcrum and the slide assembly 22 will move the inlet valve stem 23 and inlet valve 2 to the closed position as shown in FIG. 8 of the drawings.

In the closed position the high pressure steam in the inlet flow passage 4 will bleed off and when the condition which caused the overspeeding of the turbine is corrected, the safety trip valve 5 may now be opened manually quite easily because the forces acting across this safety trip valve are now balanced.

When the turbine is to be brought back for line operation, the handle 61 is now manually operated to incrementally permit steam at line pressure and temperature to be gradually passed through the inlet flow passage 4 for operation of the turbine.

The inlet valve 2 is thus gradually opened until the pivot arm 12 engages the stop member 62 at which point the governor can continue its normal control of the inlet valve 2 through the governor control linkage assembly 10 in the conventional manner as will be understood by those skilled in the art.

To retrofit an existing turbine installation with a Woodward T. G.-10 governor, the conventional governer control lever and the fulcrum bracket therefore will be replaced with the governor control linkage assembly 10 as above described by fitting the fulcrum and manual operating assembly 40 to a suitable cover 21 for the steam chest and fastening the same in assembled position. The inlet valve stem will be fastened in the main lever through the slide assembly 22. And the main lever 11 and pivot arm 12 connected to the manner shown.

ANOTHER FORM OF GOVERNOR CONTROL LINKAGE ASSEMBLY

Figure 9:
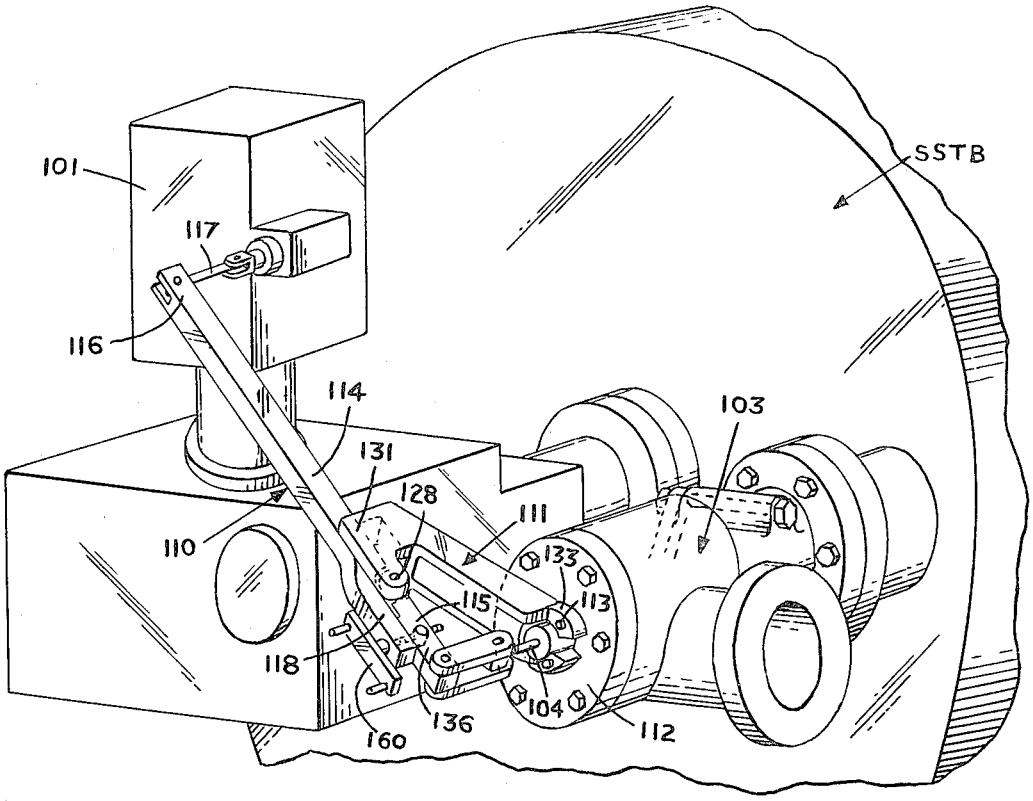
FIG. 9 is a partial perspective view of a portion of the casing of a steam turbine showing a Woodward PG type governor with another form of governor control linkage assembly in accordance with the present invention.
Figure 11:
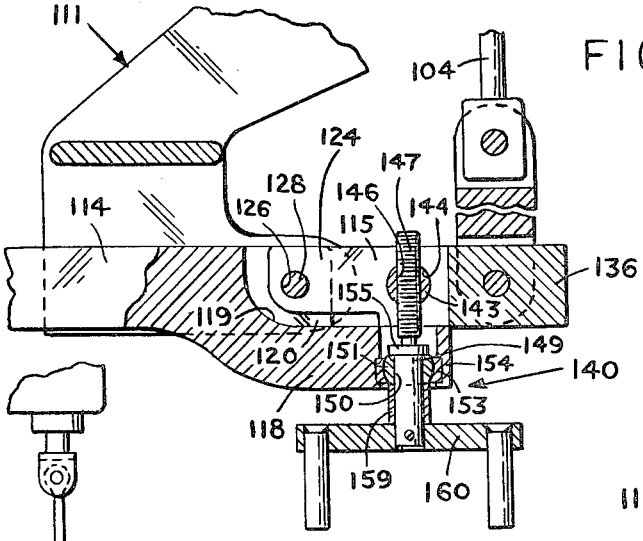
FIG. 11 is an enlarged view aprtly in horizontal cross-section of the manual operating means for the governor control linkage assembly shown in FIG. 10.
Figure 10:
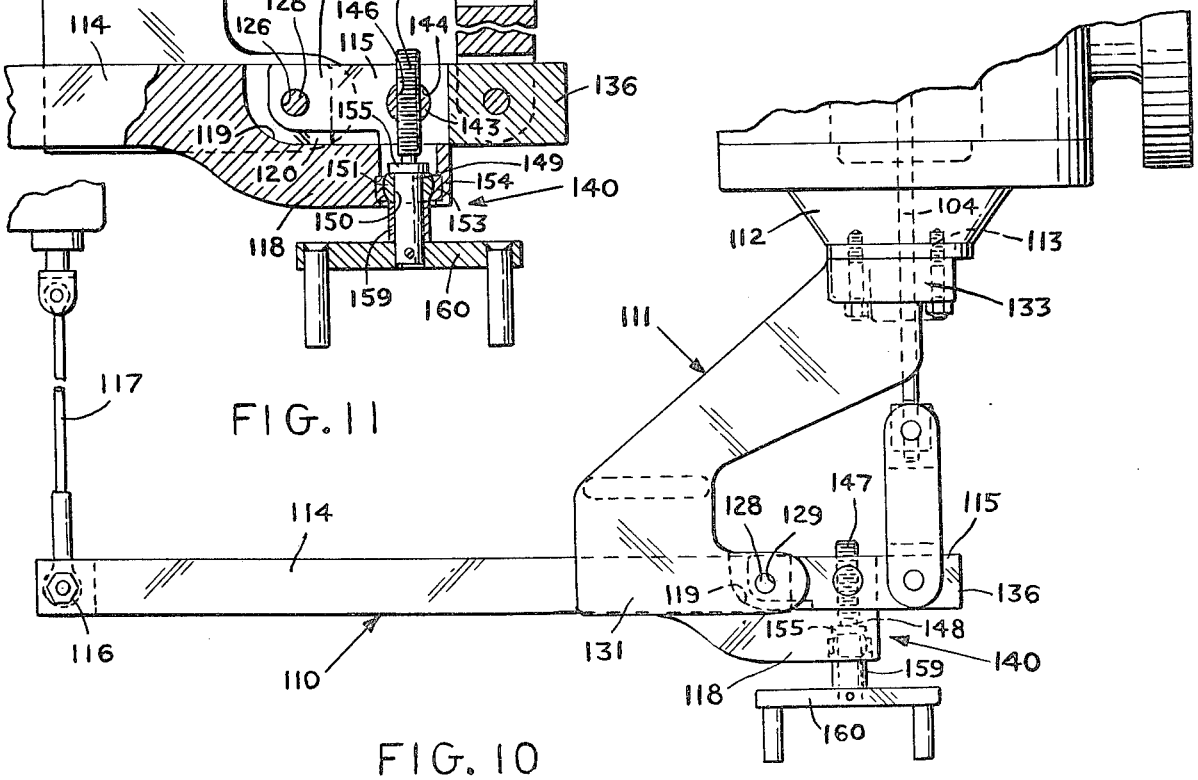
FIG. 10 is an enlarged top view of the governor control linkage assembly shown in FIG. 9.
Figure 13:
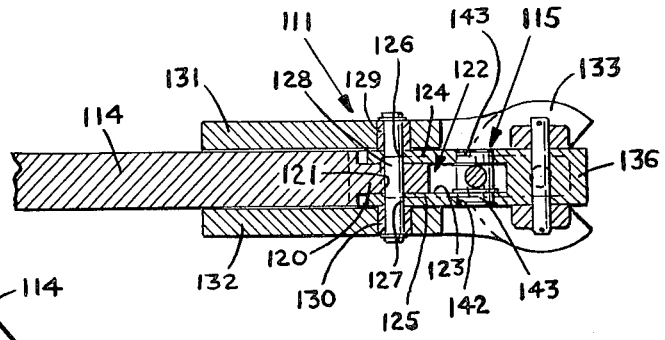
FIG. 13 is an enlarged view in horizontal cross-section of the fulcrum pivot shaft for the governor control linkage assembly shown in FIG. 10.
Figure 14:
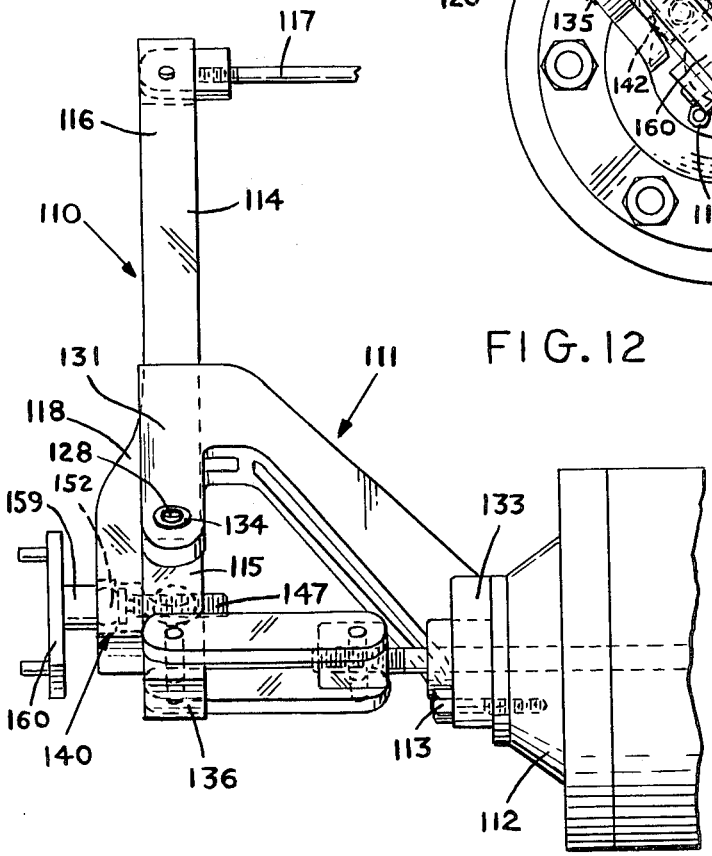
FIG. 14 is a right side view of the governor control linkage shown in FIG. 10.
Figure 15:
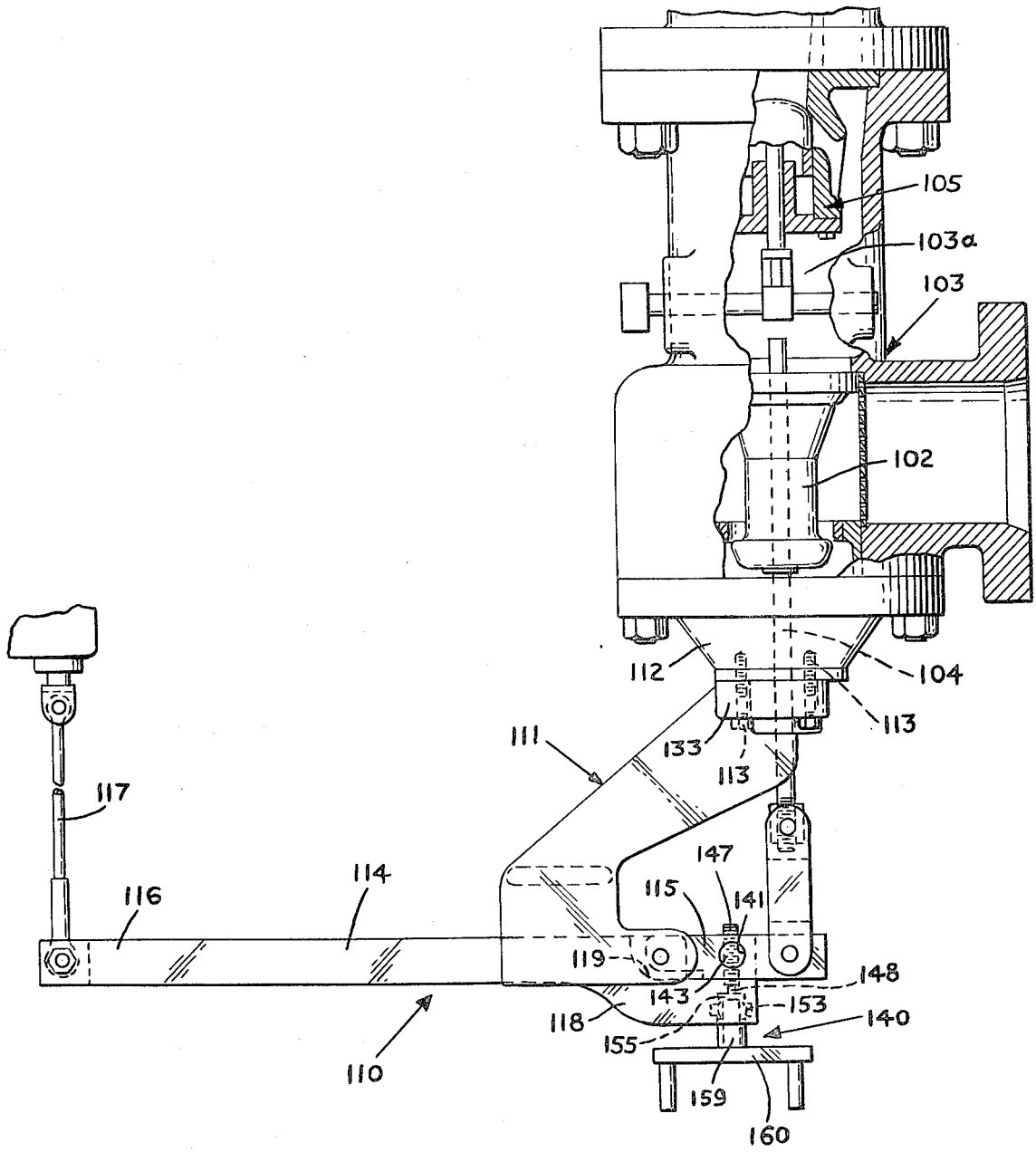
FIG. 15 is a diagrammatic sketch of the governor controlled linkage assembly shown in FIGS. 9 and 10 in operative association with the inlet valve in the steam chest of the turbine in the open position, and showing the safety trip valve in the inlet flow passage in the closed position.
Figure 16:
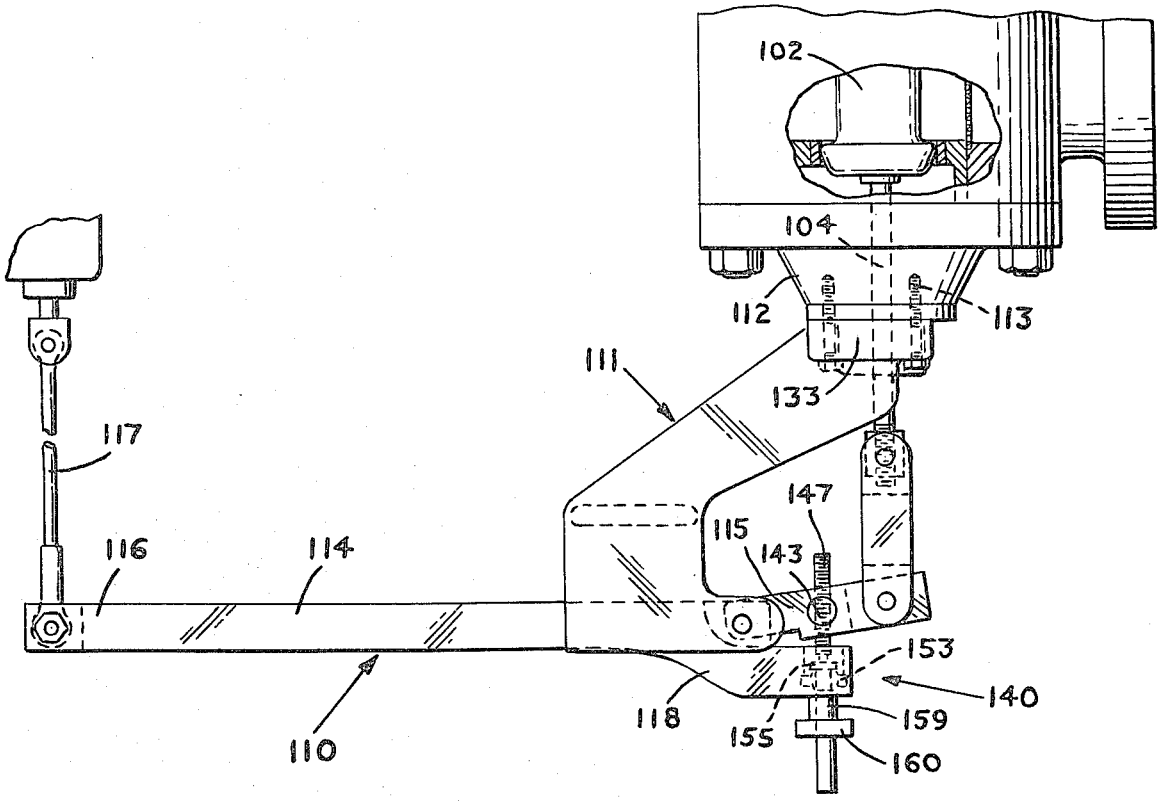
FIG. 16 is a fragment of the same diagrammatic sketch as FIG. 15 with the governor control linkage assembly and the inlet valve in the closed position.

Now referring to FIGS. 9, 14 and 15 of the drawings, another form of governer control linkage assembly in accordance with the present invention is illustrated on one end of a single stage turbine generally designated SSTB which has a Woodward PG type governor 101 thereon for controlling the governor or inlet valve 102 which communicates with the steam chest generally designated 103 of the turbine.

The steam chest connects with the inlet passage 104 for delivering steam to the turbine and in the inlet passage 103*a* downstream of the inlet valve 102 will be a safety trip valve 105.

Woodward PG type governors are well known and easily purchaseable on the open market as will be understood by those skilled in the art.

Governor 101 is connected to one end of a governor control linkage assembly generally designated 110 in accordance with this form of the invention and the opposite end thereof is connected to the valve stem 104 of the governor or inlet valve 102. The governor control linkage assembly 110 is pivotally supported in the medial section thereof by a bracket 111 which is connected to the steam chest cover 112 by spaced threaded members 113 so that the governor control linkage assembly performs as a second class lever mechanism that can pivot in a clockwise and counter-clockwise direction.

Those skilled in the art will readily understand that the governor will actuate the movement of the governor control linkage assembly 110 in accordance with the speed setting desired for the turbine, i.e., when the turbine reduces its rotational speed due to an increased load, the governor will cause the governor control linkage assembly to rotate counter-clockwise to move the associated governor or inlet valve 102 to increase the opening to the inlet flow passage 104 and thus increase the flow of steam to the turbine and the turbine speed to the point necessary to meet the requirements of the load. Conversely when the load decreases causing the turbine to increase its speed of rotation, the governor control linkage assembly will be operated by the governor to rotate in a clockwise direction so as to cause the inlet valve 102 to reduce the opening to the inlet flow passage 104 and thus reduce the amount of steam flowing to the turbine and the speed thereof.

Since a reduction in the speed of the governor 101 causes the governor control linkage assembly 110 to move the inlet valve 102 so that it increases the opening to the inlet passage 103*a* those skilled in the art will understand that when the safety trip valve 105 is tripped and cuts off the flow of steam in the turbine that the reduction in the speed of turbine as it slows down to the shutdown or stopped position responsive to the trip will cause the governor 101 to move the governor or inlet valve 102 to the full open position as is shown in FIG. 15 of the drawings.

If this open position as shown in FIG. 15 of the drawings does not correct itself substantially instantaneously when the safety trip valve is manually opened to permit steam to flow to the steam turbine once again the wide opened position of the governor or inlet valve 102 will cause the turbine to overspeed and trip the safety trip valve once again. This form of the invention provides another device to facilitate overcoming this problem.

Thus referring to FIGS. 9 to 14 of the drawings this form of governor control linkage assembly 110 is shown to include a main lever 114 and a pivot arm 115 which are articulated to each other and operatively associated so that the pivot arm 115 can be displaced relative the main lever 114 and utilized to move the governor or inlet valve 102 from the opened to the closed position and from the closed to opened position to achieve the advantageous results of the present invention.

Main lever 114 is a generally elongated element which is connected at one end 116 to the exterior end of the actuating rod 117 which is responsive to the speed of rotation of the control element, not shown, in the governor 110. Since those skilled in the art are fully familiar with the operation of Woodward type governors as illustrated herein, they will readily understand that the signals of the governor are thus delivered through the actuating rod 117 directly to the end of the main lever 114.

Figure 12:
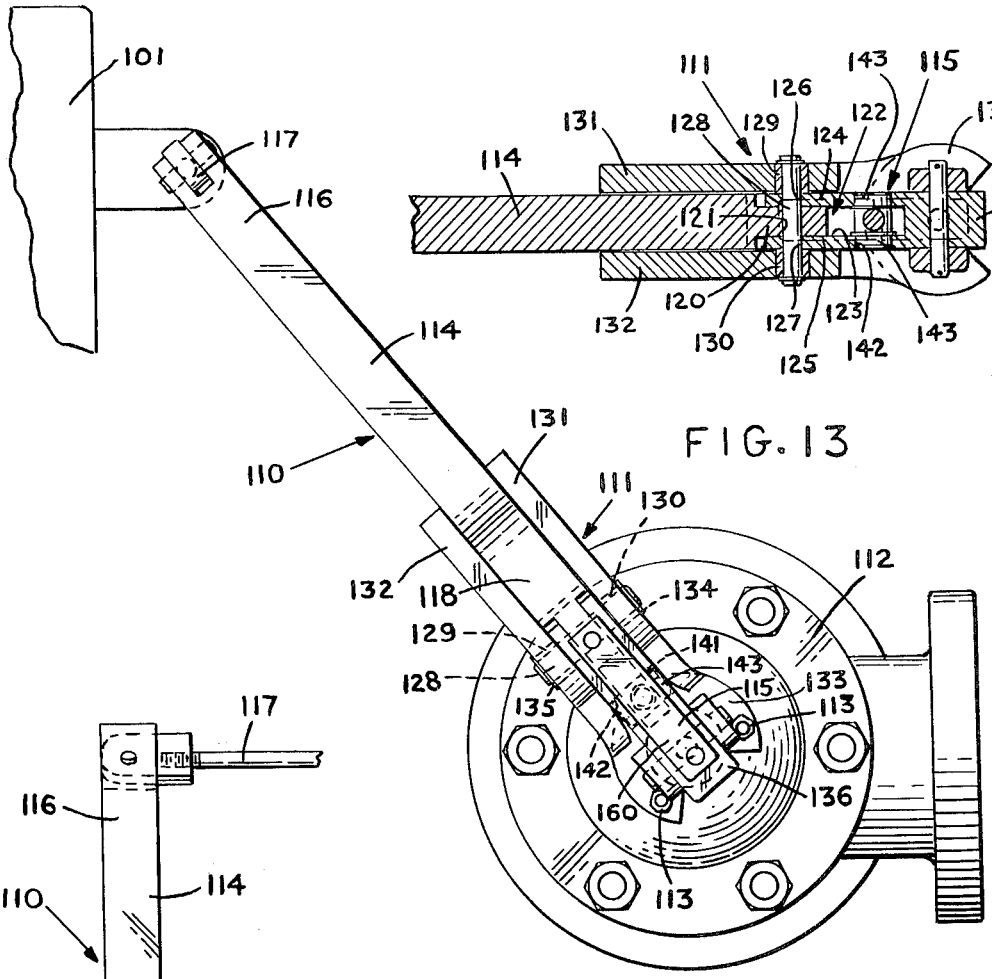
FIG. 12 is an enlarged end view of the governor control linkage assembly shown in FIG. 10.

The end 118 of main lever 114 opposite from the end 116 has a predetermined portion thereof undercut or milled as at 119 to form inwardly of the end 118 a tonque of tennon 120 which has a bore 121 therethrough, as shown at FIG. 12. The effect of this contruction is that the end 118 of the main lever 114 projects beyond the tongue or tennon 120.

Pivot arm 115 is a relatively shorter element then the main lever 114 being dimensioned and sized for the desired operation in accordance with the present invention as is more fully described hereinafter. Inwardly from the end 122 thereof it is grooved as at 123 to form substantially parallel legs as at 124 and 125 which have aligned bores 126 and 127 therethrough adjacent to the end 122. The parallel legs 124 and 125 at the end 122 are sized to permit this end of the pivot arm 115 to fit into the undercut or milled section 119. In this assembled position the bores 126 and 127 can be brought into alignment with the bore 121 on the tongue 120 so that a fulcrum pin 128 can extend therethrough to form the articulating joint between these elements.

The fulcrum pin 128 also extends through aligned bearings 129 and 130 in the side supports 131 and 132 which extend outwardly or upwardly from the base 133 of the bracket 111 for supporting the governor control linkage assembly 110 and to form the above mentioned second class lever. The fulcrum pin is releasably connected in the openings 129 and 130 by suitable snap rings as at 134 and 135 or any other suitable type of connecting means to permit the fulcrum pin to be removed when it is desired to disassemble the governor control linkage assembly 110.

At the end 136 opposite from end 122 of the pivot arm 115 the pivot arm is connected to the exterior end of the valve stem 104 of the governor or inlet valve 102. Thus the pivot arm 115 can act to move the valve stem and hence the valve 102 during the auxiliary operation of the governor control linkage 110 for overcoming the problem which has heretofore occurred when the safety trip valve 105 has been tripped.

A manual operating assembly 140 connected to the end 118 of the main lever 114 which projects beyond the tongue 120 provides means for both holding the pivot arm 115 to the main lever 114 and for moving the pivot arm 115 to accomplish the advantageous results of the present invention.

Thus referring further to FIGS. 11, 12, 13 and 14 of the drawings, the pivot arm is shown as having aligned openings 141 and 142 in the legs 124 and 125 to permit a trunnion 143 to be removably mounted therein as by snap rings. A threaded bore 146 extending through the trunnion 143 will lie transverse or perpendicular to the longitudinal axis of the groove 123 to permit the threaded end 147 of a screw member 148 to extend for threaded engagement with the threaded bore 146 in the trunnion 143.

The screw member 148 has only a portion thereof which is threaded. The end opposite from the threaded end as at 149 is rotatably disposed in a bore 150 extending end to end through the inner section 151 of a spherical bearing 152, the outer section 153 of which is fixedly connected in a bearing housing opening 154 provided in the projecting portion of the end 118 of the main lever 114.

A lower shoulder 155 is formed on the screw member 148 for engagement with the lower or inner face of the spherical bearing 153 and a sized upper spacer 159 is provided to permit a handle 160 to be affixed to the upper end of the screw member 148 to hold the screw member 148 in assembled position and at the same time to permit the screw member to be rotated freely.

Under normal operating conditions, the handle member 160 and screw member 148 will be rotated to hold the main lever 114 and the pivot arm 115 so that their respective longitudinal axis will be parallel or in alignment with each other and thus provide a substantially continuous unitary lever of the second class which will pivot around the fulcrum pin 128 so that signals delivered to end 116 of the main lever will be transmitted through the governor control linkage assembly 110 to the valve stem 104 connected to the end 136 of the pivot arm 115.

Thus the governor control linkage assembly 110 will operate similar to the conventional known prior art type of governor control linkages in transmitting the governor signals to the valve stem of the governor or inlet valve 102.

OPERATION

In this form of the invention, after the safety trip valve has been tripped the governor control linkage assembly 110 can be operated to move the governor or inlet valve 102 to the closed position by rotating handle 160 which in turn causes the screw member 148 to thread in a direction which will move the pivot arm 115 relative the main lever 114 sufficiently to move the valve stem and the governor inlet valve 102 to the closed position as shown in FIG. 15 of the drawings.

When the governor or inlet valve 102 is moved to the closed position, the steam trapped in the inlet passage 103*a* between the governor or inlet valve 102 and the safety trip valve will bleed off through the safety trip valve and thus reduce the unbalanced forces acting across the valve head of the safety trip valve which can now be manually moved to the open position relatively easily because of the reduction in these unbalanced forces.

When it is desired to place the shut down or stopped turbine back into operation, the handle member 160 can now be utilized to move the screw member so as to slowly introduce steam through the inlet passage to the turbine thus slowly bringing the turbine up to operating speed at which time the governor will again take over signalling the desired operation through the governor control linkage assembly 110 which is now locked so that the pivot arm 115 and main lever 114 are again in substantial parallel alignment with each other for normal operation.

This form of the invention can be retrofitted to an existing turbine installation by substituting the fulcrum bracket and governor control linkage assembly as above described in place of the conventional governor control.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. A governor control linkage assembly for connecting a governor to the valve stem of a governor valve to be controlled by said governor and to enable manual closing and opening of said governor valve, comprising:

a. bracket means, b. an articulated linkage including a main lever member connected at one end to said governor and a pivot arm member pivotally connected to the opposite end of said main lever member and pivotably connected to the bracket to accommodate rotational movement of the linkage about the pivotal connection between the pivot arm and the bracket;

c. said valve stem being operatively connected for swivelling movement to one of the members of said articulated linkage in a fashion accommodating relative rotational and lateral movement between said member and the valve stem; and d. operating means connected to the pivot arm at a point spaced from the pivotal connection between the pivot arm and the bracket for moving the pivot arm member relative to the main lever member in a pivotal fashion to selectively displace the valve stem to cause the valve being controlled by the governor to be moved incrementally from open to closed position and vice versa.

2. In a governor control linkage assembly as claimed in claim 1 wherein the pivot arm member is relatively shorter than the main lever member, and the predetermined movement of the pivot arm member and main lever member is sufficient to provide the desired closing and opening action of the governor valve.

3. A governor control linkage assembly for connecting a governor to the valve stem of a governor valve to be controled by said governor and to enable manual closing and opening of said governor valve, comprising:

a. main lever means connected at one end to said governor, b. pivot arm means pivotally connected to the opposite end of said main lever means, c. the valve stem of the valve to be controlled operatively connected for swivelling movement to the main lever means, d. fulcrum means connected to the end of said pivot arm means remote from the pivotally connected end thereof, and e. manual operating means connected to said pivot arm means between the pivotally connected end and the fulcrum for selectively moving the same relative to the main lever means to cause the valve being controlled by the governor to be moved incrementally from open to closed position and vice versa.

4. In a governor control linkage assembly as claimed in claim 3 wherein;

a. said manual operating means includes, a swivelling mounted threaded member having one end connected to the pivot arm means, and handle means connected to the other end of said threaded member, and b. said swivelly mounted valve stem and said swivelly mounted threaded member disposed in substantially parallel alignment with each other.

5. A governor control linkage assembly for connecting a governor to the valve stem of a governor valve to be controlled by said governor and to enable manual closing and opening of said governor valve, comprising:

a. bracket means, b. main lever means connected at one end to said governor.

c. pivot arm means pivotally connected to the opposite end of said main lever means, d. the valve stem of the valve to be controlled operatively connected for swivelling movement to the main lever means, e. fulcrum means mounted on said bracket means and connected to the end of said pivot arm means remote from the pivotal connected end thereof, and f. manual operating means mounted on said bracket means including threaded means connected to said pivot arm means between the pivotally connected end and the fulcrum for selectively moving the same relative to the main lever means to cause the valve being controlled by the governor to be moved incrementally from open to closed position and vice versa.

6. In a governor control linkage assembly as claimed in claim 5 wherein;

a. pivot shaft means on the bracket provides the fulcrum means which accomodates predetermined arcuate movement of the pivot arm means about said pivot shaft means, and b. said threaded member on the manual operating means is swivally mounted on the bracket means to assist the arcuate movement of the pivot arm means.

7. In a governor control linkage assembly as claimed in claim 6 wherein the pivot arm means is relatively shorter than the main lever means, and the predetermined arcuate movement is sufficient to provide the desired closing and opening action of the governor valve.

8. A governor control linkage assembly for connecting a governor to the valve stem of a governor valve to be controlled by said governor and to enable manual closing and opening of said governor valve, comprising:

a. bracket means, b. main lever means connected at one end to said governor, c. pivot arm means pivotally connected to the opposite end of said main lever means and to said bracket means to form a second class lever when said main lever means and pivot arm means are in alignment with each other, d. said pivot arm means swivelably connected to the valve stem of the valve to be controlled at the end remote from the pivotal connection with said bracket means, and e. manually operable means connected between said main lever means and said pivot arm means for moving the pivot arm means relative the main lever means to cause the valve being controlled by the governor to be moved incrementally from open to closed position and vice versa.

9. In a governor control linkage assembly as claimed in claim 8 wherein;

a. the pivotal connection between said pivot arm means and the bracket means accommodates predetermined arcuate movement of the pivot arm means about the pivotal connection, and b. the manually operable means includes a threaded member swivally connected to the pivot arm means to assist the predetermined arcuate movement of the pivot arm means, and a handle means connected to the end of the threaded member remote from the pivot arm means.

10. In a governor control linkage assembly as claimed in claim 9 wherein the pivot arm means is relatively shorter than the main lever means, and the predetermined arcuate movement is sufficient to provide the desired closing and opening action of the governor valve.

11. The combination with a turbine having, a governor, a governor valve, and a safety trip valve downstream of the governor valve of a governor control linkage assembly for connecting the governor to the valve stem for the governor valve to be controlled by the governor and to enable manual closing of said governor valve after the safety trip valve has been tripped and for incremental opening of said governor valve for restarting the turbine from the shut down and stopped operating conditions, comprising:

a. bracket means connected to said turbine, b. an articulated linkage including a main lever member connected at one end to said governor and a pivot arm member pivotally connected to the opposite end of said main lever means and pivotally connected to the bracket to accommodate rotational movement of the linkage about the pivotal connection between the pivot arm and the bracket, c. said valve stem being operatively connected for swivelling movement to one of the members of said articulated linkage in a fashion accommodating relative rotational and lateral movement between said member and the valve stem, and d. operating means connected to the pivot arm at a point spaced from the pivotal connection between the pivot arm and the bracket for moving the pivot arm member relative to the main lever member to cause the valve being controlled by the governor to be moved incrementally from open to closed position and vice versa.

12. In the combination as claimed in claim 11 wherein the pivot arm member is relatively shorter than the main lever member, and the predetermined movement of the pivot arm member and main lever member is sufficient to provide the desired closing and opening action of the governor valve.

13. The combination with a turbine having a governor, a governor valve, and a safety trip valve downstream from the governor valve of a governor control linkage assembly for connecting the governor to the valve stem for the governor valve to be controlled by the governor and to enable manual closing of said governor valve after the safety trip valve has been tripped and for incremental opening of said governor valve for restarting the turbine from the shut down and stopped operating conditions, comprising:

a. bracket means, b. main lever means connected at one end to said governor, c. pivot arm means pivotally connected to the opposite end of said main lever means, d. the valve stem of the valve to be controlled operatively connected for swivelling movement to the main lever means, e. fulcrum means mounted on said bracket means and connected to the end of said pivot arm means remote from the pivotally connected end thereof, and f. manual operating means mounted on said bracket means including threaded means connected to said pivot arm means between the pivotally connected end and the fulcrum for selectively moving the same relative to the main lever means to cause the valve being controlled by the governor to be moved incrementally from open to closed position and vice versa.

14. In the combination as claimed in claim 13 wherein;

a. pivot shaft means on the bracket provides the fulcrum means which accommodates pedetermined arcuate movement of the pivot arm means about said pivot shaft means, and b. said threaded member on the manual operating means is swivally mounted on the bracket means to assist the arcuate movement of the pivot arm means.

15. In the combination as claimed in claim 14 wherein the pivot arm means is relatively shorter than the main lever means, and the predetermined arcuate movement is sufficient to provide the desired closing and opening action of the governor valve.

16. The combination with a turbine having, a governor, a governor valve, and a safety trip valve downstream of the governor valve of a governor control linkage assembly for connecting the governor to the valve stem for the governor valve to be controlled by the governor and to enable manual closing of said governor valve after the safety trip valve has been tripped and for incremental opening of said governor valve for restarting the turbine from the shut down and stopped operating conditions, comprising:

a. bracket means, b. main lever means connected at one end to said governor, c. pivot arm means pivotally connected to the opposite end of said main lever means and to said bracket means to form a second class lever when said main lever means and pivot arm means are in alignment with each other, d. said pivot arm means swivelably connected to the valve stem of the valve to be controlled at the end remote from the pivotal connection with said bracket means, and e. manually operable means connected between said main lever means and said pivot arm means for moving the pivot arm means relative the main lever means to cause the valve being controlled by the governor to be moved incrementally from open to closed position and vice versa.

17. In the combination as claimed in claim 16 wherein;

a. said pivot arm means is connected to the pivotal connection with the bracket means to permit predetermined arcuate movement thereof about the pivotal connection, and b. the manually operable means includes a threaded member swivally connected to the pivot arm means to assist the predetermined arcuate movement of the pivot arm means, and handle means connected to the end of the threaded member remote from the pivot arm means.

18. In the combination as claimed in claim 17 wherein the pivot arm means is relatively shorter than the main lever means, and the predetermined arcuate movement is sufficient to provide the desired closing and opening action of the governor valve.

* * * * *